US008315111B2

(12) United States Patent
Simons

(10) Patent No.: US 8,315,111 B2
(45) Date of Patent: Nov. 20, 2012

(54) VOLTAGE REGULATOR WITH PRE-CHARGE CIRCUIT

(75) Inventor: Sven Simons, Gratkorn (AT)

(73) Assignee: NXP B.V., Eindhoven (NL)

( * ) Notice: Subject to any disclaimer, the term of this patent is extended or adjusted under 35 U.S.C. 154(b) by 90 days.

(21) Appl. No.: 13/011,237

(22) Filed: Jan. 21, 2011

(65) Prior Publication Data

US 2012/0187935 A1 Jul. 26, 2012

(51) Int. Cl.
*G05F 3/08* (2006.01)

(52) U.S. Cl. ..... 365/189.09; 323/313; 327/543

(58) Field of Classification Search ..... 323/222, 323/224, 272, 274, 282–290, 311, 312, 313, 323/315; 327/379, 388, 390, 391, 437, 535, 327/540, 546; 307/150, 227, 264, 464, 499; 365/203, 204, 226, 227
See application file for complete search history.

(56) References Cited

U.S. PATENT DOCUMENTS

| | | | | |
|---|---|---|---|---|
| 5,373,226 | A * | 12/1994 | Kimura | 323/313 |
| 5,384,740 | A * | 1/1995 | Etoh et al. | 365/189.09 |
| 5,387,830 | A * | 2/1995 | Kukimoto | 327/322 |
| 5,436,552 | A * | 7/1995 | Kajimoto | 323/313 |
| 6,617,833 | B1 * | 9/2003 | Xi | 323/282 |
| 6,919,713 | B2 * | 7/2005 | Hoshino et al. | 323/267 |
| 7,368,896 | B2 * | 5/2008 | Nagata et al. | 323/280 |
| 7,373,226 | B1 * | 5/2008 | Cancilla et al. | 701/34.2 |
| 7,791,327 | B2 * | 9/2010 | Liu | 323/285 |

* cited by examiner

*Primary Examiner* — Rajnikant Patel

(57) ABSTRACT

A regulator circuit is provided having multiple regulated output voltages. In accordance with various example embodiments, a regulator includes first and second pass transistors driven by a reference voltage generator circuit. The first pass transistor has a gate coupled to an output of the reference voltage generator circuit. A switching circuit is configured to couple the output of the reference voltage generator circuit to the gate of the second pass transistor in response to the enable signal being in a first state. The regulator includes a pre-charge circuit configured to charge the gate of the second pass transistor in response to an enable signal being in the first state.

20 Claims, 2 Drawing Sheets

VOLTAGE REGULATOR WITH PRE-CHARGE CIRCUIT

Figure 1:
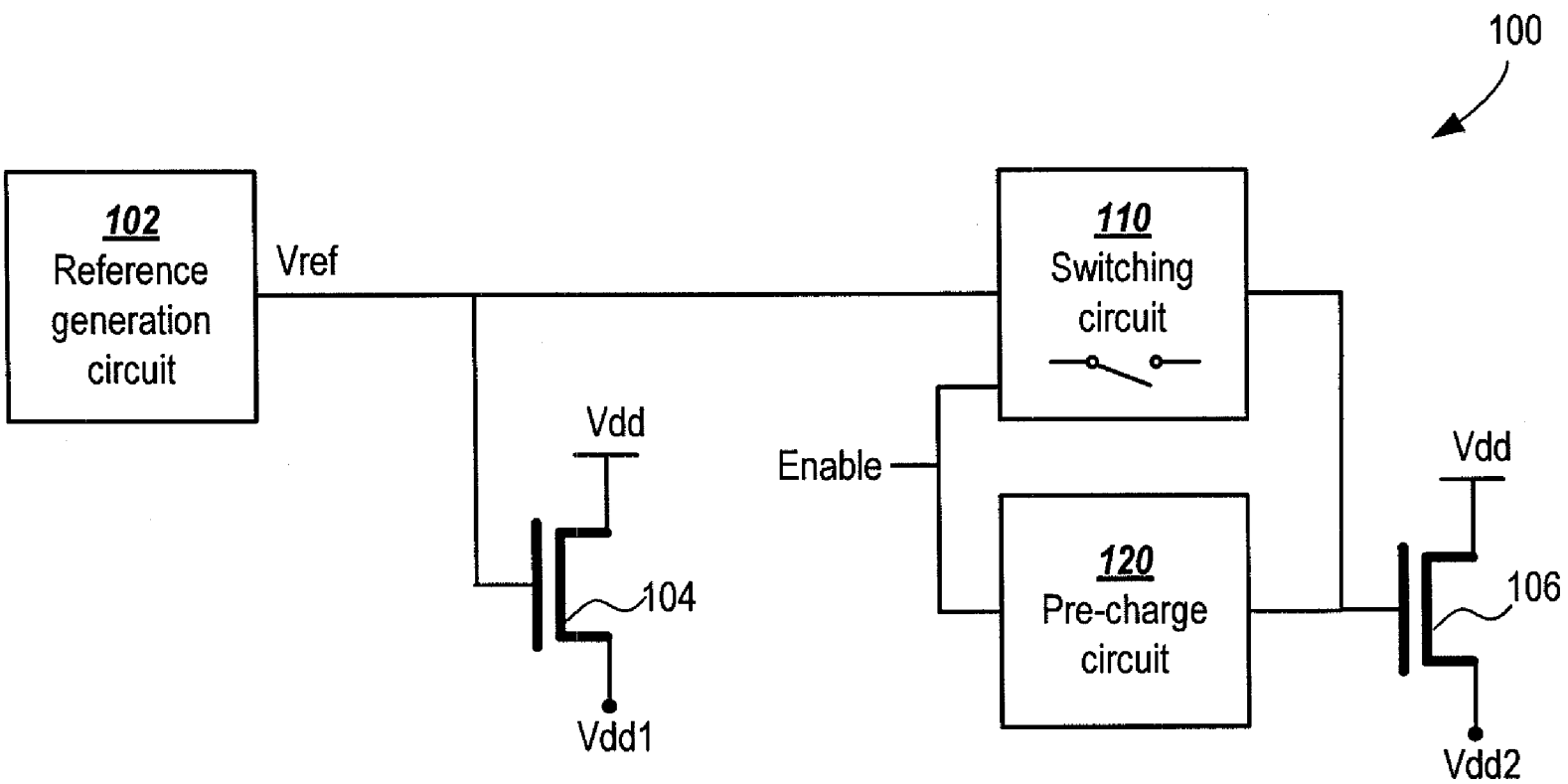

Voltage regulators are often used in electronic devices to generate a stable output voltage from an inconsistent power supply. The current load of a device may change dynamically during operation. This change may cause fluctuations in the operating voltage, which may adversely affect operation of the device. A voltage regulator adjusts supplied power according to changes in the load in order to maintain a stable voltage.

One type of voltage regulator known as a low drop out (LDO) regulator is characterized by its low dropout voltage. In these contexts, the term dropout voltage is generally used to refer to the minimum difference between the input unregulated voltage to the LDO regulator (such as a battery or a transformer) and the regulated voltage output from the LDO regulator at max output current conditions. Linear regulators maintain the regulated output voltage while an unregulated voltage supply remains above the dropout voltage. LDO regulators exhibit a relatively small dropout voltage that helps extend the life of the battery because the LDO regulator can continue to provide a regulated voltage until the battery is discharged to a value that is within a relatively close range (e.g., 100-500 millivolts) of the regulated voltage. LDO regulators generally include a first amplifier stage and a second amplifier stage. The first amplifier stage generates a reference voltage that is used to drive the second amplifier stage.

In one embodiment, a regulator circuit is provided having multiple regulated output voltages. The regulator includes first and second pass transistors driven by a reference voltage generator circuit. The first pass transistor has a first source/drain coupled to a voltage source, a gate coupled to an output of the reference voltage generator circuit, and a second source/drain configured to output a first regulated output voltage. The second pass transistor has a first source/drain coupled to the voltage source and a second source/drain configured to output a second regulated output voltage. A switching circuit is configured to couple the output of the reference voltage generator circuit to the gate of the second pass transistor in response to the enable signal being in a first state. The regulator includes a pre-charge circuit configured to charge the gate of the second pass transistor in response to an enable signal being in the first state.

In another embodiment, a method is provided for generating two or more regulated voltages from a reference voltage. A gate of a first pass transistor, having a source/drain coupled to a power source, is driven with the reference voltage to produce a first regulated voltage. In response to the enable signal being in a first state, the second regulated voltage is enabled by charging the gate of a second pass transistor coupled to the power source with current originating from a current source other than the reference voltage, and driving said gate with the reference voltage to produce the second regulated voltage. In response to an enable signal being in a second state, the second regulated voltage is disabled by decoupling the reference voltage from the gate of the second pass transistor.

In yet another embodiment, a low drop-out regulator is provided. The low drop-out regulator includes a reference voltage generator circuit and a first regulated voltage circuit, including a pass transistor having a first source/drain coupled to a voltage source, having a gate coupled to an output of the reference voltage generator circuit, and having a second source/drain coupled to an output of the first regulated voltage circuit. The low drop-out regulator also includes one or more selectably enabled regulated voltage circuits. Each selectably enabled regulated voltage circuit includes a respective pass transistor having a first source/drain coupled to the voltage source and a second source/drain coupled to an output of the selectably enabled regulated voltage circuit. A respective pre-charge circuit is configured to charge the gate of the respective pass transistor in response to a respective enable signal being in a first state. Each selectably enabled regulated voltage circuit includes a respective switching circuit configured to couple the output of the reference voltage generator circuit to the gate of the respective pass transistor in response to the respective enable signal being in the first state.

The above discussion is not intended to describe each embodiment or every implementation. The figures and following description also exemplify various embodiments.

Figure 2:
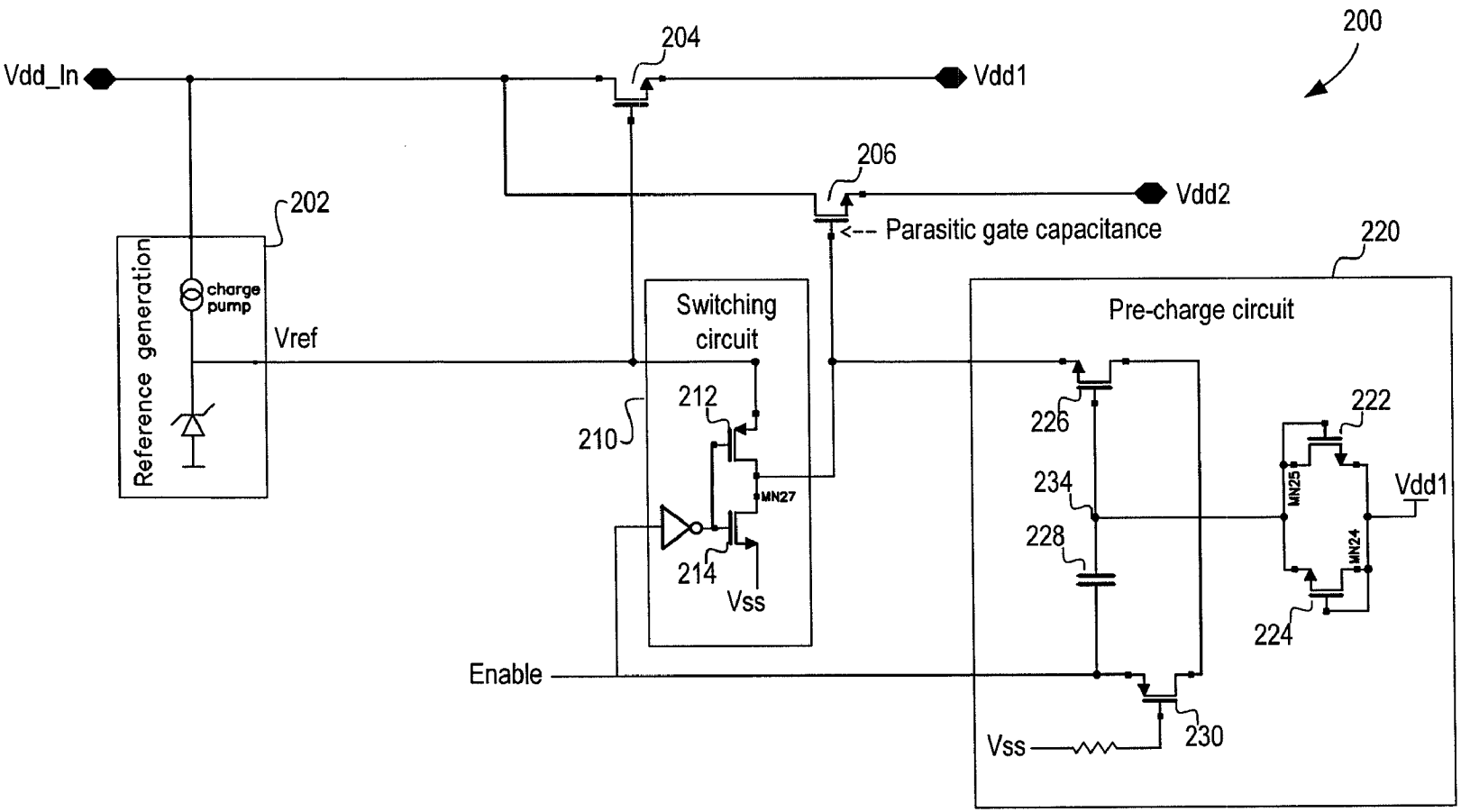

Various example embodiments may be more completely understood in consideration of the following detailed description in connection with the accompanying drawings, in which:

FIG. 1 shows a block diagram of an example LDO regulator circuit having multiple regulated output voltages and pre-charge circuitry; and FIG. 2 shows a circuit diagram of an example implementation of the LDO regulator shown in FIG. 1.

While the disclosure is amenable to various modifications and alternative forms, examples thereof have been shown by way of example in the drawings and will be described in detail. It should be understood, however, that the intention is not to limit the disclosure to the particular embodiments shown and/or described. On the contrary, the intention is to cover all modifications, equivalents, and alternatives falling within the spirit and scope of the disclosure.

The disclosed embodiments are believed to be applicable to a variety of different types of processes, devices, and arrangements for use with various regulator circuits. While the embodiments are not necessarily so limited, various aspects of the disclosure may be appreciated through a discussion of examples using this context.

One or more example embodiments are directed to a regulator circuit having pre-charge circuitry configured to reduce fluctuation of a shared reference voltage when enabling and disabling circuits are used to generate respective regulated output voltages. The embodiments may be adapted to implement a number of types of regulator circuits that generate multiple regulated voltages from a single reference voltage. For ease of illustration, the embodiments are primarily described with reference to an LDO regulator that generates two regulated voltages.

In another example embodiment, a regulator circuit includes a first stage configured to generate a reference voltage. For each regulated voltage of the regulator, a secondary stage generates the respective regulated voltage from the reference voltage. At least one of the secondary stages may be independently enabled or disabled as desired. Each secondary stage is implemented using an amplifier circuit that has at least one transistor gate coupled to receive the reference voltage when the secondary stage is enabled. Each secondary stage is enabled and disabled by connecting or disconnecting the gate to or from the reference voltage.

When a secondary stage is first enabled, the gate will draw a small current as capacitance of the gate is charged, which may partially discharge the input gate of another secondary stage. Under this condition, a pre-charge circuit generates a current to charge the gate capacitance of a secondary stage that may be dynamically enabled/disabled to reduce the amount of power drawn from the gates of other secondary stages. In this manner, current drawn from gates of other secondary stages is reduced.

In accordance with various example embodiments, a regulator circuit generates and outputs multiple regulated voltages, and mitigates fluctuation in the supply of a regulated voltage to a circuit component. The various regulated voltages may be used to power various circuits of a device. To save power, the regulator may be configured to independently disable one or more unused ones of the multiple regulated voltages. In such implementations, the effect of the enabling and disabling of one of the regulated voltages upon other regulated voltages is controlled to mitigate interference that may otherwise interfere with other ones of the multiple regulated voltages.

In some example embodiments, one reference voltage is used to drive two or more regulated voltages by driving two or more second amplifier stages and a pre-charge function is used to mitigate certain effects related to voltage drops as may arise from the powering of amplifier stages. A regulated voltage output is enabled/disabled by coupling/decoupling the reference voltage from the input to the respective second amplifier stage. Secondary amplifier stages often include a large transistor having a gate driven by the reference voltage, which may have a significant parasitic gate capacitance. This capacitance is charged to a threshold voltage before the transistor will be activated. The pre-charge function is used to address the time that it may take to charge the gate capacitance using only the reference voltage, and/or effects relating to such charging drawing power from the gates of other transistors also driven by the reference voltage (e.g., due to the limited amount of current supplied via the reference voltage source).

The gate voltage of one or more transistors may drop due to a variety of conditions, such as those relating to the capacitances of other secondary regulator stages that are coupled to the reference voltage when one of the regulated voltage outputs is enabled, or to the impedance of the circuit or circuits generating the reference voltage. Fluctuation in the gate voltages may modify the transconductance of the transistors and ultimately affect the generated regulated voltages. Accordingly, various embodiments are directed to implementation in these situations to mitigate or prevent such fluctuation in gate voltages.

One skilled in the art will recognize that secondary stages as discussed in connection with various embodiments may be implemented using a variety of gate driven amplifier circuits. In some embodiments, secondary state amplifier circuits may be implemented using pass transistors. Such a pass transistor may include, for example, a MOSFET coupled in a pull-up configuration with a voltage source and driven by the reference voltage. In some other embodiments, the secondary state amplifier circuits may be implemented using a CMOS driver circuit, an operational amplifier, or other circuit with similar functionality. For ease of description and illustration, the following embodiments describe secondary stages implemented as pass transistors; however, it is to be understood that other circuits can be used, in connection with these and other embodiments, to effect functions similar to those functions characterized in accordance with the pass transistors below.

FIG. 1 shows a block diagram of an example LDO regulator circuit 100, in accordance with another example embodiment. The regulator circuit 100 is configured to generate two regulated output voltages that may be independently enabled or disabled. The LDO regulator circuit 100 includes a reference voltage generation circuit 102 in a first stage. The reference generation circuit 102 generates a reference voltage (Vref) output to drive first and second secondary stages respectively including pass transistors 104 and 106. The pass transistors each generate a respective regulated voltage from the reference voltage. The regulator circuit 100 includes pre-charge circuitry 120 that reduces fluctuation of a reference voltage when enabling one of the multiple regulated output voltages.

In some embodiments, the first pass transistor 104 cannot be disabled and will continuously generate a regulated voltage output Vdd1 while the LDO regulator circuit 100 is operated. The second pass transistor 106 may be enabled/disabled according to a control signal (Enable). When regulated voltage Vdd2 is enabled, switching circuit 110 couples Vref to a gate of the second pass transistor 106. As discussed above, when the gate is first coupled to Vref, the uncharged gate of the second pass transistor 106 may draw power from the charged gate of the first pass transistor 104.

To reduce the amount of power drawn from the gate of pass transistor 106, pre-charge circuit 120 charges the gate of the second pass transistor 106 when regulated voltage Vdd2 becomes enabled. The pre-charge circuit provides a current source to charge the gate capacitance of the second pass transistor 106 in addition to current provided by the reference voltage. This additional current source reduces current that may be drawn from the gate of the first pass transistor 104 when the gate of the second pass transistor 106 is coupled to the reference voltage.

FIG. 2 shows an example implementation of the LDO regulator circuit shown in FIG. 1. In this example implementation, reference voltage generator circuit 202 is formed using a charge pump and Zener diode. The reference voltage is coupled to the gate of a first pass transistor 204. The example switching circuit is implemented using a CMOS switch (212 and 214). The PMOS transistor 212 couples Vref to the gate of the second pass transistor 206 when the enable signal is set high to enable generation of regulated voltage Vdd2. When the enable signal is low, the PMOS transistor 212 is disabled and NMOS transistor 214 is enabled to discharge the gate. As a result, regulated voltage Vdd2 is disabled.

When the regulated output Vdd2 is enabled without any pre-charge, the gate capacitance of pass transistor 206 will draw power from the reference generation circuit 202 and the gate of the first pass transistor 204. The time needed to enable regulated output voltage Vdd2 is the longer one of charging the load connected to Vdd2 or the charging of the gate of the second pass transistor 206.

In this example, the pre-charge circuit charges the gate of the second pass transistor 206 using regulated voltage Vdd1 that is continuously generated by the first pass transistor 204. While Vdd2 is disabled (i.e., enable signal is low), the capacitor node 234 is coupled to regulated voltage Vdd1 by two diodes (222 and 224) arranged in an anti-parallel configuration, where the diodes are coupled in parallel with opposite polarities. As a result, capacitor 228 will be charged to at least Vdd1 less the threshold voltage (Vth) of diode 224.

When Vdd2 output is enabled, the enable signal is high and node 234 is pushed up to about Vdd1+Vth by capacitor 228 and the enable signal. In this example, diode 222 prevents node 234 from exceeding Vdd1+Vth. In this condition, NMOS transistor 226 will conduct current until the source reaches a voltage equal to Vdd1 (i.e., Node 234−Vth). In this implementation, PMOS transistor 230 conducts current when enable signal is high.

Because the voltage at the gate of pass transistor 206 is now pre-charged to Vdd1 by the pre-charge circuit 220, the power required from the reference circuit or the gate of pass transistor 204 is reduced. The pre-charged voltage reduces any voltage drop of Vref and reduces the time required to enable pass transistor 206. When Vdd2 domain is switched off, NMOS transistor 230 prevents the low enable signal from pulling down Vref before the switching circuit decouples Vref from the gate of pass transistor 206.

One skilled in the art will recognize that other circuit arrangements may be used to perform the functions performed by the reference voltage generation 202, switching circuit 210, and pre-charge circuit 220.

The following discussion characterizes various embodiments that may be implemented using one or more circuits as shown in connection with FIGS. 1 and/or 2, or as described above. Such embodiments may employ similar or the same type of circuitry.

In one embodiment, a regulator circuit generates multiple regulated output voltages which may be individually enabled or disabled. The regulator circuit includes two or more pass transistors that are selectably driven by a reference voltage generator circuit to generate the respective first and second regulated output voltages. Each of the two or more pass transistors has a first source/drain coupled to a voltage source and a second source/drain coupled to output a regulated output voltage. When a regulated output voltage is enabled, the reference voltage is coupled to the gate of the corresponding pass transistor by a respective switching circuit. When a regulated output voltage is disabled, the reference voltage is decoupled from the gate of the corresponding pass transistor. For each of the two or more pass transistors, a respective pre-charge circuit is coupled to charge the gate of the pass transistor when the corresponding regulated output voltage is enabled as discussed above. As one example implementation, the circuit depicted in FIG. 1 may be modified to add a third pass transistor (not shown), a second pre-charge circuit (not shown), and a second switching circuit (not shown) interconnected in the same manner as pass transistor 106, pre charge circuit 120, and switching circuit 110. The second pre-charge circuit and switching circuit are enabled by a second enable signal.

In some implementations, the reference voltage is coupled/decoupled to/from one of the pass transistors using a switching circuit that couples the reference voltage to the gate of a corresponding pass transistor in response to an enable signal. For instance, a developer may configure the regulator to a particular application by enabling or disabling desired pass transistors. In some embodiments, the pass transistors may be dynamically enabled or disabled using the enable signals. The regulator includes a pre-charge circuit that charges the gate of the second pass transistor in response to an enable signal.

In some embodiments, the first and second pass transistors implemented in accordance with the above discussion have different gate dimensions. Since the first and second pass transistors are driven with the same reference voltage, they will pass different amounts of current. As a result, the regulated output voltages produced by the first and second pass transistors will be different.

The pre-charge circuit is configured to provide a current to a gate in addition to the current provided by the reference voltage generator circuit. The additional current reduces the amount of current that may be drawn from other gates coupled to the reference voltage. In some embodiments, the current provided by the pre-charge circuit is sufficient to prevent a substantial voltage drop at the gate of the other pass transistor (e.g., while certain minor fluctuation in voltage occurs, a significant drop that may hinder the operation of the circuit can be prevented). In other embodiments, the current provided by the pre-charge circuit is sufficient to prevent any voltage drop at the gate of the other pass transistor, such that any voltage drop is negligible, or does not occur.

In some embodiments, the pre-charge circuit is coupled to the gate of a pass transistor via a path having an impedance that is lower than an impedance of the switching circuit, which couples the gate to the reference voltage. In this manner, current provided by the pre-charge circuit to charge the gate is increased in relation to current provided by the reference voltage transistor gates coupled thereto. The pre-charge circuit will also provide a larger percent of current to charge the gate when the pre-charge circuit is configured to exhibit a lower impedance than the reference generation circuit. In one or more embodiments, the switching circuit is configured to ensure the pre-charge circuit provides a majority of the current to charge the gate by delaying coupling of the output of the reference voltage generator circuit to the gate of the gate, after being enabled, in relation to the time in which the pre-charge circuit begins charging the gate. The switching circuit may delay coupling in a number of ways. For example, the coupling may be delayed by impedance of the switching circuit or delaying the enable signal that is input to the switching circuit.

The pre-charge circuit provides a current to the gate of the corresponding pass gate from the regulated voltage output of the other pass transistor, in accordance with certain embodiments. In some implementations, the regulated voltage output from the other pass transistor is always enabled during operation of the regulator circuit. In such embodiments, the gate of the other pass transistor may be coupled directly to the output of the reference voltage generator circuit.

Based upon the above discussion and illustrations, those skilled in the art will readily recognize that various modifications and changes may be made without strictly following the exemplary embodiments and applications illustrated and described herein. For example, different types of regulator circuits having multiple regulated outputs may be implemented. Such modifications do not depart from the true spirit and scope of the present disclosure, including that set forth in the following claims.

What is claimed is:

1. A regulator circuit comprising:

a reference voltage generator circuit that is configured to generate a reference voltage at an output of the reference voltage generator;

a first gate driven amplifier having a gate coupled to the output of the reference voltage generator circuit and configured to output a first regulated output voltage in response to the reference voltage being applied to the gate of the first gate driven amplifier;

a second gate driven amplifier having a gate and configured to output a second regulated output voltage in response to a voltage applied to the gate of the second gate driven amplifier;

a switching circuit configured to, in response to an enable signal, couple the output of the reference voltage generator circuit to the gate of the second gate driven amplifier; and a pre-charge circuit configured to mitigate voltage draw from the gate of the first gate driven amplifier to the gate of the second gate driven amplifier, by charging the gate of the second gate driven amplifier in response to the enable signal.

2. The regulator circuit of claim 1, wherein:

the first gate driven amplifier is a first pass transistor having a first source/drain coupled to a voltage source, a gate coupled to an output of the reference voltage generator circuit, and a second source/drain configured to output the first regulated output voltage; and the second gate driven amplifier is a second pass transistor having a first source/drain coupled to the voltage source and a second source/drain configured to output the second regulated output voltage.

3. The regulator circuit of claim 2, wherein the gates of the first and second pass transistors have different gate dimensions.

4. The regulator circuit of claim 1, wherein the switching circuit couples and uncouples the output of the reference voltage generator circuit to and from the gate of the second gate driven amplifier to respectively enable and disable generation of the second regulated output voltage.

5. The regulator circuit of claim 1, wherein the pre-charge circuit is configured to provide current to the gate of the second gate driven amplifier that is sufficient to prevent a voltage drop at the gate of the first gate driven amplifier when the switching circuit couples the output of the reference voltage generator circuit to the gate of the second gate driven amplifier.

6. The regulator of claim 1, wherein the gate of the first gate driven amplifier is coupled directly to the output of the reference voltage generator circuit.

7. The regulator of claim 1, wherein the pre-charge circuit is configured to charge the gate of the second gate driven amplifier to a voltage equal to the first regulated output voltage.

8. The regulator of claim 2, further comprising:

a third gate driven amplifier having a first source/drain coupled to the voltage source and a second source drain coupled to output a third regulated output voltage;

a second pre-charge circuit configured to charge the gate of the third gate driven amplifier in response to a second enable signal; and a second switching circuit configured to, in response to the second enable signal, couple the output of the reference voltage generator circuit to the gate of the second gate driven amplifier.

9. The regulator of claim 1, wherein the reference voltage generation circuit has a high impedance, relative to an impedance of the pre-charge circuit.

10. The regulator of claim 1, wherein the switching circuit is configured to delay coupling of the output of the reference voltage generator circuit to the gate of the second gate driven amplifier, relative to an initiation of the charging of the gate of the second gate driven amplifier via the pre-charge circuit.

11. The regulator of claim 1, wherein:

the pre-charge circuit includes a transistor configured to couple a current source to the gate of the second gate driven amplifier in response to the enable signal; and the pre-charge circuit is configured to regulate a capacitor coupled to a gate of the transistor via a pair of diodes arranged in an anti-parallel configuration.

12. The regulator of claim 11, wherein the diodes are diode connected MOSFET transistors.

13. A method of providing two or more regulated voltages from a reference voltage, the method comprising:

driving the gate of a first pass transistor, having a source/drain coupled to a power source, with the reference voltage to produce a first regulated voltage;

in response to an enable signal being in a first state, enabling a second regulated voltage by charging the gate of a second pass transistor coupled to the power source with current originating from a source other than the reference voltage, and driving said gate with the reference voltage to produce the second regulated voltage; and in response to the enable signal being in a second state, disabling the second regulated voltage by decoupling the reference voltage from the gate of the second pass transistor.

14. The method of claim 13, wherein charging the gate of the second pass transistor includes charging the gate with the first regulated voltage.

15. The method of claim 13, further comprising:

charging a capacitor in response to the enable signal being in the second state; and wherein charging the gate of the second pass transistor includes coupling the capacitor to the gate of the second pass transistor in response to the enable signal being in the first state.

16. The method of claim 15, wherein coupling the capacitor to the gate of the second pass transistor includes providing a current to the gate of the second pass transistor sufficient to prevent a voltage drop at the gate of the first pass transistor while the gate of the second pass transistor is charged.

17. The method of claim 15, wherein charging the gate of the second pass transistor includes coupling the capacitor to the gate of the second pass transistor with a coupling circuit, in response to the enable signal being in the first state, and further including generating the reference voltage with a reference voltage generator circuit having a high impedance in relation to the coupling circuit.

18. The method of claim 13, wherein driving the gate of the first-pass transistor includes coupling the gate directly to the output of the reference voltage generator circuit that generates the reference voltage.

19. A low drop-out regulator comprising:

a reference voltage generator circuit;

a first regulated voltage circuit, including a pass transistor having a first source/drain coupled to a voltage source, a gate coupled to an output of the reference voltage generator circuit, and a second source/drain coupled to an output of the first regulated voltage circuit;

at least one selectably enabled regulated voltage circuit, each selectably enabled regulated voltage circuit including:

a pass transistor having a first source/drain coupled to the voltage source and a second source/drain coupled to an output of the selectably enabled regulated voltage circuit;

a pre-charge circuit configured to charge the gate of the pass transistor in response to an enable signal being in a first state; and a switching circuit configured to, in response to the enable signal being in the first state, couple the output of the reference voltage generator circuit to the gate of the pass transistor.

20. The low drop-out regulator of claim 19, wherein the pre-charge circuit is configured to:

charge a capacitor in response to the respective enable signal being in a first state; and in response to the respective enable signal being in a second state, couple the capacitor to the gate of the pass transistor.

* * * * *